US008905010B2

(12) United States Patent
Spix et al.

(10) Patent No.: US 8,905,010 B2
(45) Date of Patent: Dec. 9, 2014

(54) POSITIVE CRANKCASE VENTILATION SYSTEM FOR A TWO-CYLINDER ENGINE

(71) Applicant: GM Global Technology Operations LLC, Detroit, MI (US)

(72) Inventors: Thomas A. Spix, Rochester Hills, MI (US); Jason G Kohler, Waterford, MI (US)

(73) Assignee: GM Global Technology Operations, Detroit, MI (US)

( * ) Notice: Subject to any disclaimer, the term of this patent is extended or adjusted under 35 U.S.C. 154(b) by 0 days.

(21) Appl. No.: 13/785,440

(22) Filed: Mar. 5, 2013

(65) Prior Publication Data

US 2014/0251291 A1 Sep. 11, 2014

(51) Int. Cl.
*F02B 25/06* (2006.01)
*F02M 25/06* (2006.01)

(52) U.S. Cl.
CPC ..... *F02M 25/06* (2013.01)
USPC ..... 123/572

(58) Field of Classification Search
CPC ..... F01M 13/00; F01M 13/04; F02B 2075/1808; F02M 25/06
USPC ..... 123/572–574, 196 CP, 198 E, 70 R, 71 R, 123/72, 73 R
See application file for complete search history.

(56) References Cited

U.S. PATENT DOCUMENTS

| | | | | |
|---|---|---|---|---|
| 4,501,234 | A * | 2/1985 | Toki et al. | 123/41.86 |
| 5,881,686 | A * | 3/1999 | Schmidt | 123/41.86 |
| 6,945,201 | B2 * | 9/2005 | Taxon et al. | 123/41.86 |

* cited by examiner

*Primary Examiner* — Hung Q Nguyen
(74) *Attorney, Agent, or Firm* — Quinn Law Group, PLLC

(57) ABSTRACT

An engine assembly includes a two-cylinder engine, an intake assembly, and an air-oil separator. The two-cylinder engine defines a first cylinder bore, a first combustion chamber, a second cylinder bore, a second combustion chamber, and a crankcase volume. The engine further includes a first piston disposed within the first cylinder bore, and a second piston disposed within the second cylinder bore. The intake assembly includes an intake manifold in fluid communication with each of the first and second combustion chambers, and the air-oil separator defines a separator volume and in fluid communication with each of the crankcase volume and the intake manifold. A reciprocal, synchronous motion of the first and second pistons is operative to exhale gas from the crankcase volume through the separator volume and into the intake manifold.

15 Claims, 1 Drawing Sheet

POSITIVE CRANKCASE VENTILATION SYSTEM FOR A TWO-CYLINDER ENGINE

TECHNICAL FIELD

The present invention relates generally to a positive crankcase ventilation system for a two-cylinder engine.

BACKGROUND

During engine operation, combustion gas may leak between the cylinder and the corresponding piston rings, and into the engine crankcase. The leaked combustion gas is referred to as blowby gas, and typically includes intake air, unburned fuel, exhaust gas, oil mist, and water vapor. In an effort to ventilate the crankcase and re-circulate the blowby gas to the intake side of the engine, a positive crankcase ventilation (PCV) system may be used.

SUMMARY

An engine assembly includes a two-cylinder engine, an intake assembly, and an air-oil separator. The two-cylinder engine defines a first cylinder bore, a first combustion chamber, a second cylinder bore, a second combustion chamber, and a crankcase volume. The engine further includes a first piston disposed within the first cylinder bore, and a second piston disposed within the second cylinder bore.

The intake assembly includes an air cleaner assembly, a throttle, and an intake manifold disposed in a series arrangement, with the intake manifold in fluid communication with each of the first and second combustion chambers. The crankcase volume may be fluidly coupled with the intake manifold through a first fluid conduit, and may be coupled with the air cleaner assembly through a second fluid conduit.

A synchronous motion of the first and second pistons toward a bottom-dead-center position is operative to actively exhale gas from the crankcase volume into the intake manifold. Conversely a synchronous motion of the first and second pistons toward a top-dead-center position is operative to actively draw gas into the crankcase volume from the air cleaner assembly.

The air-oil separator may be fluidly disposed along the first fluid conduit between the crankcase volume and the intake manifold. It may be configured to extract oil from the exhaled gas flowing from the crankcase volume to the intake manifold.

A first check valve may be fluidly disposed along the first fluid conduit between the crankcase volume and the intake manifold, such that it restricts fluid flow from the intake manifold into the crankcase volume. Similarly, a second check valve may be fluidly disposed along the second fluid conduit between the crankcase volume and the intake assembly. The second check valve may restrict fluid flow from the crankcase volume into the intake assembly.

The throttle is configured to selectively restrict air flow from the air cleaner assembly to the intake manifold. A pressure differential across the throttle may thus be operative to passively draw gas from the crankcase volume into the intake manifold.

The above features and advantages and other features and advantages of the present invention are readily apparent from the following detailed description of the best modes for carrying out the invention when taken in connection with the accompanying drawings.

DETAILED DESCRIPTION

Figure 1:
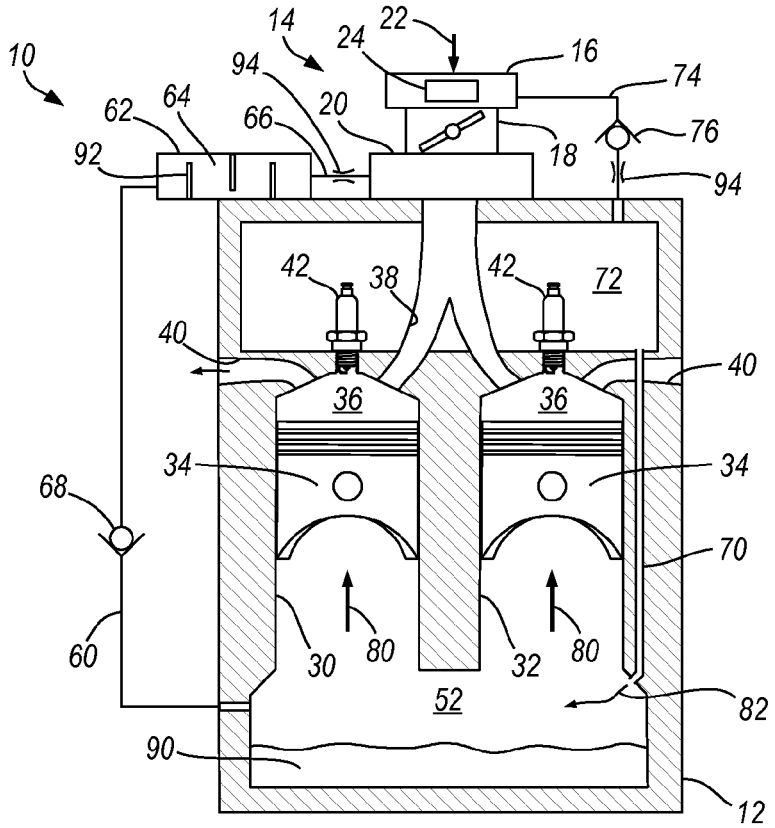
FIG. 1 is a schematic partial cross-sectional illustration of a positive crankcase ventilation system operating with a 2-cylinder engine assembly, where the two pistons are approaching a top-dead-center position.

Referring to the drawings, wherein like reference numerals are used to identify like or identical components in the various views, FIG. 1 schematically illustrates an engine assembly 10 including both an engine 12 and an intake assembly 14. The intake assembly 14 may include, for example, an air cleaner assembly 16, a throttle 18, and an intake manifold 20 disposed in a series arrangement. The throttle 18 may be disposed between the air cleaner assembly 16 and the intake manifold 20, and may be configured to selectively restrict the flow of air 22 into the intake manifold 20. The air cleaner assembly 16 may include housings, ports, and/or conduit that may be located upstream of the throttle 18. In one configuration, the air cleaner assembly 16 may include, for example, an air filter 24 with a sufficient porosity or other construction to filter airborne debris from the intake air 22 prior to its passage into the intake manifold 20.

The engine 12 may generally include an engine block, a cylinder head, an oil pan, and an engine cylinder head cover. The engine 12 may be a 2-cylinder engine that defines a first cylinder/cylinder bore 30 and a second cylinder/cylinder bore 32. Each of the cylinders 30, 32 may include a respective reciprocating piston 34 disposed therein. The cylinders 30, 32 may be arranged in any suitable manner, such as, without limitation, a V-engine arrangement, an inline engine arrangement, and a horizontally opposed engine arrangement, as well as using both overhead cam and cam-in-block configurations.

The engine 12 may define a combustion chamber 36 for each respective cylinder 30, 32. Additionally, one or more intake passages 38 and exhaust passages 40 may be in selective fluid communication with each combustion chamber 36. Each intake passage 38 may be used to deliver an air/fuel mixture to a respective combustion chamber 36 from the intake manifold 20. Following combustion of the air/fuel mixture (such as when ignited by a spark from a spark plug 42), the exhaust passage 40 may carry exhaust gasses out of the combustion chamber 36.

Figure 2:
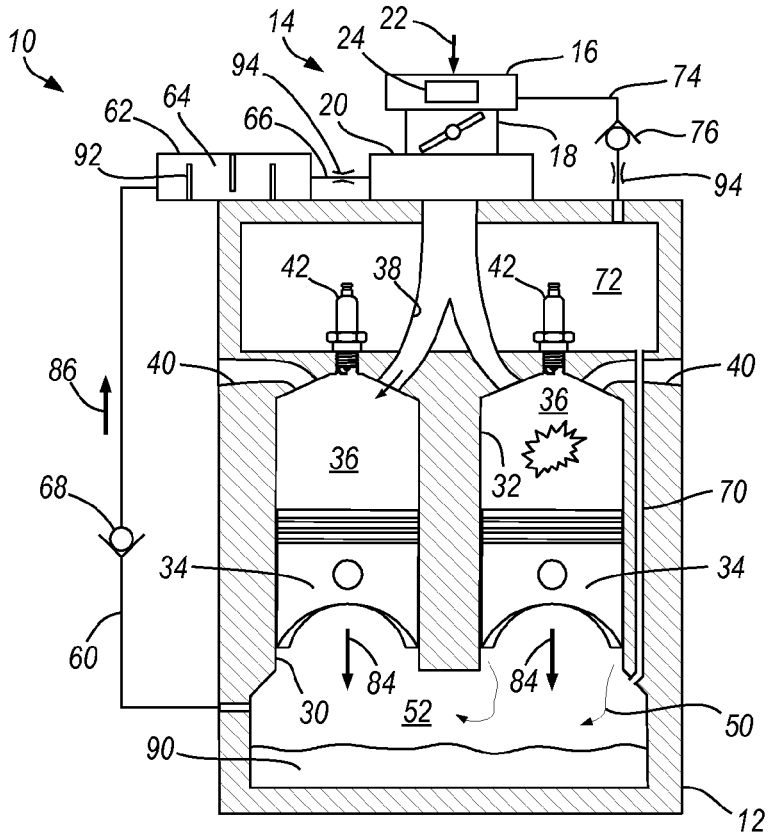
FIG. 2 is a schematic partial cross-sectional illustration of a positive crankcase ventilation system operating with a 2-cylinder engine assembly, where the two pistons are approaching a bottom-dead-center position.

FIGS. 1 and 2 illustrate two phases of the engine 12 operation. As shown, FIG. 1 illustrates the first cylinder 30 in an exhaust stroke, and the second cylinder in a compression stroke. Likewise, FIG. 2 illustrates the first cylinder 30 in an intake stroke, and the second cylinder 32 in a power stroke. As shown, the pistons 34 may move in unison, though only one may be combusting fuel at a given time (i.e., in FIG. 1 both pistons may be moving toward top-dead-center in synchrony, and in FIG. 2, both pistons may be moving towards bottom-dead-center in synchrony).

During the intake stroke, the piston 34 motion may draw intake air 22 through the air cleaner assembly 16, past the throttle 18, through the intake manifold 20 and intake passage 38, and into the combustion chamber 36, where fuel may be introduced via fuel injectors (not shown). During the power stroke of the piston 34, as illustrated in FIG. 2, following the ignition of the air/fuel mixture in the combustion chamber 36, a portion of the combustion gas may pass between the piston 34 and the engine 12/cylinder bore 32 (i.e., blowby gas 50) and into the crankcase volume 52 (the crankcase volume 52 being generally defined by the engine 12 via the oil pan and engine block). Because the blowby gas 50 includes an amount of un-burnt fuel and products of combustion (such as water vapor), it may be desirable to avoid having these gasses accumulate within the crankcase volume 52. Accordingly, a positive crankcase ventilation system (PCV system) may be used to purge the blowby gas 50 from the crankcase volume 52.

The PCV system may utilize ducting, conduits, and/or volumes to actively vent the blowby gas 50 from the crankcase volume 52 into the intake system 14 where it may eventually be exhausted via the exhaust passage 40. More specifically, the PCV system may include a first fluid conduit 60 that fluidly couples the crankcase volume 52 with an air-oil separator 62 generally defining a separator volume 64. The separator volume 64 may also be fluidly coupled with the intake manifold 20 through a second fluid conduit 66. A check valve 68 may be disposed in line with either the first fluid conduit 62 or second fluid conduit 66, and may be configured to permit only unidirectional flow from the crankcase volume 52 into the intake manifold 20.

The PCV system may further include a third fluid conduit 70 that may couple the crankcase volume 52 with a volume 72 partially defined by the cylinder head cover (i.e., the "camshaft volume 72"). As may be appreciated, the camshaft volume 72 may contain one or more rotating camshafts that are configured to translate one or more valves. Likewise, a fourth fluid conduit 74 may couple the camshaft volume 72 with the air cleaner assembly 16, or any other point of the intake system 14 that precedes the throttle 18. In one configuration, the fourth fluid conduit 74 may merely be vented at one end to general atmospheric air (i.e., not coupled with anything). A check valve 76 may be disposed in line with either the third fluid conduit 70 or fourth fluid conduit 74, and may be configured to permit only unidirectional flow from the air cleaner 16 or atmosphere into the crankcase volume 52.

While the camshaft volume 72 is shown as being fluidly disposed between the air cleaner 16 and crankcase volume 52, in other configurations, it may be fluidly disposed between the air-oil separator 62 and the crankcase volume 52 (i.e., in line with the first fluid conduit 60). Additionally, any of the fluid conduits may be provided either by an external pipe or hose, or may be provided by internal ducting within a portion of the engine 12.

The present design may have two general modes of operation that may work concurrently to both actively and passively vent the crankcase volume 52. Passive ventilation may be generally created by the throttle 18. During normal operation (excluding wide-open throttle scenarios), the intake stroke of the engine 12 may generate a vacuum in the intake manifold 20 as a result of the throttle 18 partially blocking the intake air flow 22. This vacuum may draw the blowby gas 50 from the crankcase volume 52 through the separator volume 64 and into the intake manifold 20 via the first and second fluid conduits 60, 66. A portion of the air used to dilute the blowby gas 50 may be supplied via the third and fourth fluid conduits 70, 74, which may be coupled to the air cleaner assembly 16 upstream of the throttle 18. As such, the pressure differential across the throttle 18 may generate a motive force that may passively vent the crankcase volume 52.

Active ventilation of the crankcase volume 52 may be created by the reciprocal, synchronous piston motion. As described above, the two pistons 34 in a 2-cylinder engine generally move together. This reciprocal, synchronous motion, together with the configuration of the first and second check valves 68, 76, may create a pumping action that actively dilutes and expels the blowby gas 50 from the crankcase volume 52. FIGS. 1 and 2 generally illustrate this active pumping effect.

In FIG. 1, the two pistons 34 are each moving toward a top-dead-center position as generally shown by the motion arrows 80. This motion causes the size of the crankcase volume 52 to expand, and encourages fresh air 82 to be drawn into the crankcase volume 52. In this instance, the first check valve 68 is configured to block air flow into the crankcase volume 52, however, the second check valve 76 is configured to permit such flow. As such, when the size of the crankcase volume 52 expands, fresh air 82 is drawn into the crankcase volume 52 from the air cleaner 16/atmosphere.

In FIG. 2, the two pistons 34 are each moving toward a bottom-dead-center position as generally shown by the motion arrows 84. This motion causes the size of the crankcase volume 52 to contract, and encourages air 86 to be expelled from the crankcase volume 52. In this instance, the second check valve 76 reverses and blocks air flow out from the crankcase volume 52, however, the first check valve 68 permits such flow. As such, when the size of the crankcase volume 52 contracts air 82 and blowby gas 50 are exhaled from the crankcase volume 52 into the air-oil separator 62 (along flow-arrow 86) and eventually into the intake manifold 20. As such, the reciprocal, synchronous motion of the pistons 34 may generate a motive force that may actively vent the crankcase volume 52.

Due to engine vibrations, raw motion of the engine 12, the reciprocal motion of the pistons 34, and/or the rotating motion of the crankshaft (not shown), oil 90 contained within the crankcase volume 52 may be splashed, foamed, atomized, misted and/or sprayed within the entire volume of the crankcase 52. The atomized/particulated oil, along with the fresh intake air 82 and blowby gas 50, may collectively flow out of the crankcase volume 52. While the atomized oil may be beneficial within the crankcase volume 52 to lubricate and/or cool the various parts, it is desirable to extract as much oil 90 from the exhaled gas 86 before the gas 86 passes into the intake system 14 and combustion chamber 36.

To accomplish the desired oil-extraction, the separator volume 64 may be specially configured to separate and remove oil 90 from the flowing exhaled gas 86 and allow the oil 90 to drain back into the crankcase volume 52. For example, the separator 62 may include one or more baffles (e.g., baffle 92), fins, or restrictions extending into the separator volume 64 that may aid in separating the oil from the air. These features may aid oil extraction through, for example, flow redirection or by creating a varying pressure along the flow path.

In one configuration, a baffle 92 may define a plurality of holes through which the exhaled gas 86 must pass. The pressure differential across the baffle/holes 92 may cause any suspended oil 90 to atomize/mist upon exiting the baffle 92, which may promote ultimate separation. Likewise, inertia of the particulated oil 90 may cause the oil to collide with one of the baffles 92, walls, or other internal surfaces of the separator 62. Once in contact with the wall/surface, the surface tension of the oil 90 may cause it to cling to the surface, where it may subsequently run off (via gravity) toward a drain.

While the air-oil separator 62 is illustrated as being adjacently coupled to the engine 12, it is understood that it may be next to the engine 12, integrated within the engine 12, or even disposed within the camshaft volume 72. Finally, one or more nozzles 94, restrictor orifices, or valves may be positioned in line with the PCV system to provide a generally constant, limited flow throughout the range of various engine operating conditions.

While the best modes for carrying out the invention have been described in detail, those familiar with the art to which this invention relates will recognize various alternative designs and embodiments for practicing the invention within the scope of the appended claims. All directional references (e.g., upper, lower, upward, downward, left, right, leftward, rightward, above, below, vertical, and horizontal) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not as limiting.

The invention claimed is:

1. An engine assembly comprising:

a two-cylinder engine defining a first cylinder bore, a first combustion chamber, a second cylinder bore, a second combustion chamber, and a crankcase volume, the engine further including a first piston disposed within the first cylinder bore, and a second piston disposed within the second cylinder bore;

an intake assembly including an intake manifold, the intake manifold being in fluid communication with each of the first and second combustion chambers; and an air-oil separator defining a separator volume and in fluid communication with each of the crankcase volume and the intake manifold;

wherein the assembly is configured such that a reciprocal, synchronous motion of the first and second pistons are operative to actively exhale gas from the crankcase volume through the separator volume and into the intake manifold;

wherein the intake assembly further includes an air cleaner assembly, and a throttle;

wherein the air cleaner assembly, the throttle, the intake manifold, and each of the first and second combustion chambers are disposed in a series arrangement;

wherein the throttle is configured to selectively restrict air flow from the air cleaner assembly to the intake manifold;

wherein the crankcase volume is fluidly coupled with the air cleaner assembly;

wherein a pressure differential between the air cleaner assembly and the intake manifold is operative to draw gas from the crankcase volume through the separator volume and into the intake manifold.

2. The engine assembly of claim 1, wherein the crankcase volume is fluidly coupled with the intake assembly; and wherein a reciprocal, synchronous motion of the first and second pistons are operative to actively draw air into the crankcase volume from the intake assembly.

3. The engine assembly of claim 2, further comprising:

a first check valve fluidly disposed between the crankcase volume and the intake manifold, the first check valve configured to restrict fluid flow from the intake manifold into the crankcase volume; and a second check valve fluidly disposed between the crankcase volume and the intake assembly, the second check valve configured to restrict fluid flow from the crankcase volume into the intake assembly.

4. The engine assembly of claim 1, wherein a reciprocal, synchronous motion of the first and second pistons are operative to actively draw air into the crankcase volume from the air cleaner assembly.

5. The engine assembly of claim 1, wherein the air-oil separator is configured to extract oil from the exhaled gas flowing from the crankcase volume to the intake manifold.

6. The engine assembly of claim 1, wherein the engine further defines a camshaft volume fluidly coupled between the crankcase volume and the intake assembly.

7. An engine assembly comprising:

a two-cylinder engine defining a first cylinder bore, a first combustion chamber, a second cylinder bore, a second combustion chamber, and a crankcase volume, the engine further including a first piston disposed within the first cylinder bore, and a second piston disposed within the second cylinder bore;

an intake assembly including an air cleaner assembly, a throttle, and an intake manifold disposed in a series arrangement, the intake manifold being in fluid communication with each of the first and second combustion chambers;

wherein the crankcase volume is fluidly coupled with the intake manifold through a first fluid conduit, and wherein the crankcase volume is coupled with the air cleaner assembly through a second fluid conduit; and wherein the assembly is configured such that a reciprocal, synchronous motion of the first and second pistons are operative to actively exhale gas from the crankcase volume into the intake manifold.

8. The engine assembly of claim 7, further comprising an air-oil separator fluidly disposed along the first fluid conduit between the crankcase volume and the intake manifold; and wherein the air-oil separator is configured to extract oil from the exhaled gas flowing from the crankcase volume to the intake manifold.

9. The engine assembly of claim 7, further comprising:

a first check valve fluidly disposed along the first conduit between the crankcase volume and the intake manifold, the first check valve configured to restrict fluid flow from the intake manifold into the crankcase volume;

a second check valve fluidly disposed along the second conduit between the crankcase volume and the intake assembly, the second check valve configured to restrict fluid flow from the crankcase volume into the intake assembly; and wherein a reciprocal, synchronous motion of the first and second pistons are operative to actively draw air into the crankcase volume from the intake assembly.

10. The engine assembly of claim 7, wherein the throttle is configured to selectively restrict air flow from the air cleaner assembly to the intake manifold; and wherein a pressure differential between the air cleaner assembly and the intake manifold is operative to draw gas from the crankcase volume into the intake manifold.

11. The engine assembly of claim 7, wherein the engine further defines a camshaft volume in fluid communication with at least one of the first fluid conduit and second fluid conduit.

12. An engine assembly comprising:

a two-cylinder engine defining a first cylinder bore, a first combustion chamber, a second cylinder bore, a second combustion chamber, and a crankcase volume, the engine further including a first piston disposed within the first cylinder bore, and a second piston disposed within the second cylinder bore;

an intake assembly including an air cleaner assembly, a throttle, and an intake manifold disposed in a series arrangement, the intake manifold being in fluid communication with each of the first and second combustion chambers;

an air-oil separator defining a separator volume and configured to extract oil from gas flowing through the separator volume;

a first fluid conduit fluidly coupling the crankcase volume with the air-oil separator;

a second fluid conduit fluidly coupling the air-oil separator with the intake manifold;

a restrictor disposed along the second fluid conduit between the air-oil separator and the intake manifold to provide a generally constant, limited fluid flow to the intake manifold;

a third fluid conduit fluidly coupling the crankcase volume with the air cleaner assembly;

a first check valve fluidly disposed along either the first fluid conduit or the second fluid conduit, and configured to restrict fluid flow from the intake manifold into the crankcase volume;

a second check valve fluidly disposed along the third fluid conduit, and configured to restrict fluid flow from the crankcase volume into the intake assembly;

wherein synchronous motion of the first and second pistons toward top-dead-center are operative to actively draw air into the crankcase volume from the air cleaner assembly; and wherein synchronous motion of the first and second pistons toward bottom-dead-center are operative to actively exhale gas from the crankcase volume through the separator volume and into the intake manifold.

13. The engine assembly of claim 12, wherein the throttle is configured to selectively restrict air flow from the air cleaner assembly to the intake manifold; and wherein a pressure differential between the air cleaner assembly and the intake manifold is operative to draw gas from the crankcase volume into the intake manifold.

14. The engine assembly of claim 12, wherein the engine further defines a camshaft volume, and wherein the camshaft volume is in fluid communication with the crankcase volume through at least one of the first fluid conduit and the third fluid conduit.

15. The engine assembly of claim 12, further comprising oil disposed within a portion of the crankcase volume; and wherein operation of the engine atomizes a portion of the oil throughout the crankcase volume.

* * * * *